US006259886B1

(12) United States Patent
Ishii et al.

(10) Patent No.: US 6,259,886 B1
(45) Date of Patent: Jul. 10, 2001

(54) ELECTROPHOTOGRAPHIC PRINTING APPARATUS

(75) Inventors: Kenji Ishii; Minoru Seino, both of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/678,834

(22) Filed: Oct. 4, 2000

(30) Foreign Application Priority Data

Oct. 4, 1999 (JP) ..... 11-282459

(51) Int. Cl.[7] ..... G03G 15/00; B65H 5/00

(52) U.S. Cl. ..... 399/388; 399/394; 399/397

(58) Field of Search ..... 399/381, 388, 399/394, 395, 397; 271/270, 202

(56) References Cited

U.S. PATENT DOCUMENTS 4,240,739 * 12/1980 Koumura et al. ..... 399/139

* cited by examiner

*Primary Examiner*—Quana M Grainger
(74) *Attorney, Agent, or Firm*—Sughrue, Mion, Zinn, Macpeak & Seas, PLLC

(57) ABSTRACT

In an electrophotographic printing apparatus, when the conveying speed of the timing roller (1*a,* 1*b*) is Vt, the conveying speed of the register roller (2*a,* 2*b*) is Vr, the peripheral speed of the photoreceptor drum (3) is V0, and the conveying speed of the conveying apparatus (5) is Vf, each speed is set to satisfy the relationship of $Vf>V0 \geqq Vr>Vt$, and when a sheet deflection amount formed when the sheet comes into contact with the register roller, is δr, the sheet deflection amount at the photoreceptor drum entry section is δ0, and the sheet length is Lp, each value is regulated so that the relationships of $\delta r \geqq Lp\ ((Vr-Vt)/Vt)$ and $\delta 0 \geqq Lp\ ((Vf-V0)/V0)$ are satisfied.

4 Claims, 1 Drawing Sheet

ELECTROPHOTOGRAPHIC PRINTING APPARATUS

BACKGROUND OF THE INVENTION

1. Field of the Invention

The present invention relates to an electrophotographic printing apparatus such as a laser printer or copier.

2. Description of the Related Art

In the electrophographic printing apparatus provided with: a timing roller to convey the sheet sent from a sheet hopper at the predetermined timing; a register roller to convey the sheet in timed relationship with the timing at which the toner image formed on the photoreceptor drum surface reaches the transfer device; and a conveying apparatus to convey the sheet passed through the transfer device toward a fixing device, conventionally, the sheet conveying speed of the timing roller, register roller, and conveying apparatus is set to the same as a process speed.

By using FIG. 1, the schematic structure of the electrophotographic printing apparatus will be described below. The sheet accommodated in a sheet hopper 10, is sent out by a pick roller 9, and one sheet passed through double feeding prevention rollers 8*a* and 8*b* is sent into timing rollers 1*a* and 1*b* by conveying rollers 7*a* and 7*b*. The sheet sent out by the timing rollers 1*a* and 1*b* at the predetermined timing is sent into the stopped register rollers 2*a* and 2*b*.

Herein, in the sheet sent into the register rollers 2*a* and 2*b*, because, under the condition that the leading edge of the sheet comes into contact with the register rollers 2*a* and 2*b*, the trailing edge side is sent into the register rollers 2*a* and 2*b* by the timing rollers 1*a* and 1*b*, the deflection is formed between the timing rollers 1*a* and 1*b* and the register rollers 2*a* and 2*b*. By this deflection and the rigidity of the sheet itself, the posture of the sheet is corrected, and the leading edge of the sheet is corrected so that it comes straight into contact with the nip of the register roller 2*a* and the register roller 2*b*.

As described above, the sheet whose posture is corrected, is sent from the register rollers 2*a* and 2*b* in timed relationship with the timing at which the toner image (not shown) formed on the photoreceptor drum 3 surface reaches the transfer device 4.

The sheet holding the toner image which is transferred from the photoreceptor drum 3 and not yet fixed, is sent to the fixing device 6 through the conveying apparatus 5, and the toner image is thermally fixed onto the sheet by the fixing device 6.

When the fixed sheet is delivered outside the printing apparatus, the sheet is delivered through conveying rollers 20*a*, 20*b*, and conveying rollers 21*a* and 21*b*. Further, when the front and rear sides of the fixed sheet are reversed and the sheet is delivered outside the printing apparatus, the sheet sent from the conveying rollers 20*a* and 20*b* is introduced once into a sheet path side provided with conveying rollers 22*a*, 22*b*, 23*a* and 23*b*, then, the conveying rollers 22*a*, 22*b*, 23*a* and 23*b* are reversely rotated, and the sheet is sent to the conveying rollers 21*a* and 21*b*, and delivered. Further, when two-sided printing is conducted, the sheet sent from the conveying rollers 20*a* and 20*b* is introduced into the sheet path side provided with conveying rollers 22*a*, 22*b*, 23*a* and 23*b*, and then, the sheet is sent again to the timing rollers 1*a* and 1*b* through the two-sides conveying path (the path provided with conveying rollers 24*a*, 24*b*, 25*a*, 25*b*, 26*a* and 26*b*) branched from the sheet path, and thereby, two-sided printing is conducted.

However, in the above structure, when the sheet ream weight is large (the thickness of the sheet is large), or when the sheet length is large (A3 sheet), because, when the trailing edge of the sheet is separated from the timing roller and register roller, the deflection of the sheet is released, the vibration is generated on the sheet, and the vibration is transmitted along the sheet, and there is a disadvantage that the transfer blurring is generated when the toner image is transferred by the transfer device.

SUMMARY OF THE INVENTION

An object of the present invention is to realize an electrophotographic printing apparatus by which the vibration generated when the sheet is separated from the timing roller and register roller is suppressed, and a fine image can be obtained without the transfer blurring.

The above object can be attained by an electrophotographic printing apparatus, which comprising: a timing roller which conveys a sheet sent from a sheet hopper at the predetermined timing; a register roller to convey the sheet in timed relationship with the timing at which a toner image formed on a photoreceptor drum surface reaches a transfer device; and a conveying apparatus to convey the sheet passed through the transfer device toward a fixing device, wherein, when the conveying speed of the timing roller is Vt, the conveying speed of the register roller is Vr, the peripheral speed of the photoreceptor drum is V0, and the conveying speed of the conveying apparatus is Vf, each speed is set to satisfy the relationship of $Vf>V0\geqq Vr>Vt$, and when a sheet deflection amount formed when the sheet comes into contact with the register roller, is $\delta r$, the sheet deflection amount at the photoreceptor drum entry section is $\delta 0$, and the sheet length is Lp, each value is regulated so that the relationships of $\delta r\geqq Lp\ ((Vr-Vt)/Vt)$, and $\delta 0\geqq Lp\ ((Vf-V0)/V0)$ are satisfied.

DETAILED DESCRIPTION OF THE PREFERRED EMBODIMENTS

Figure 1:
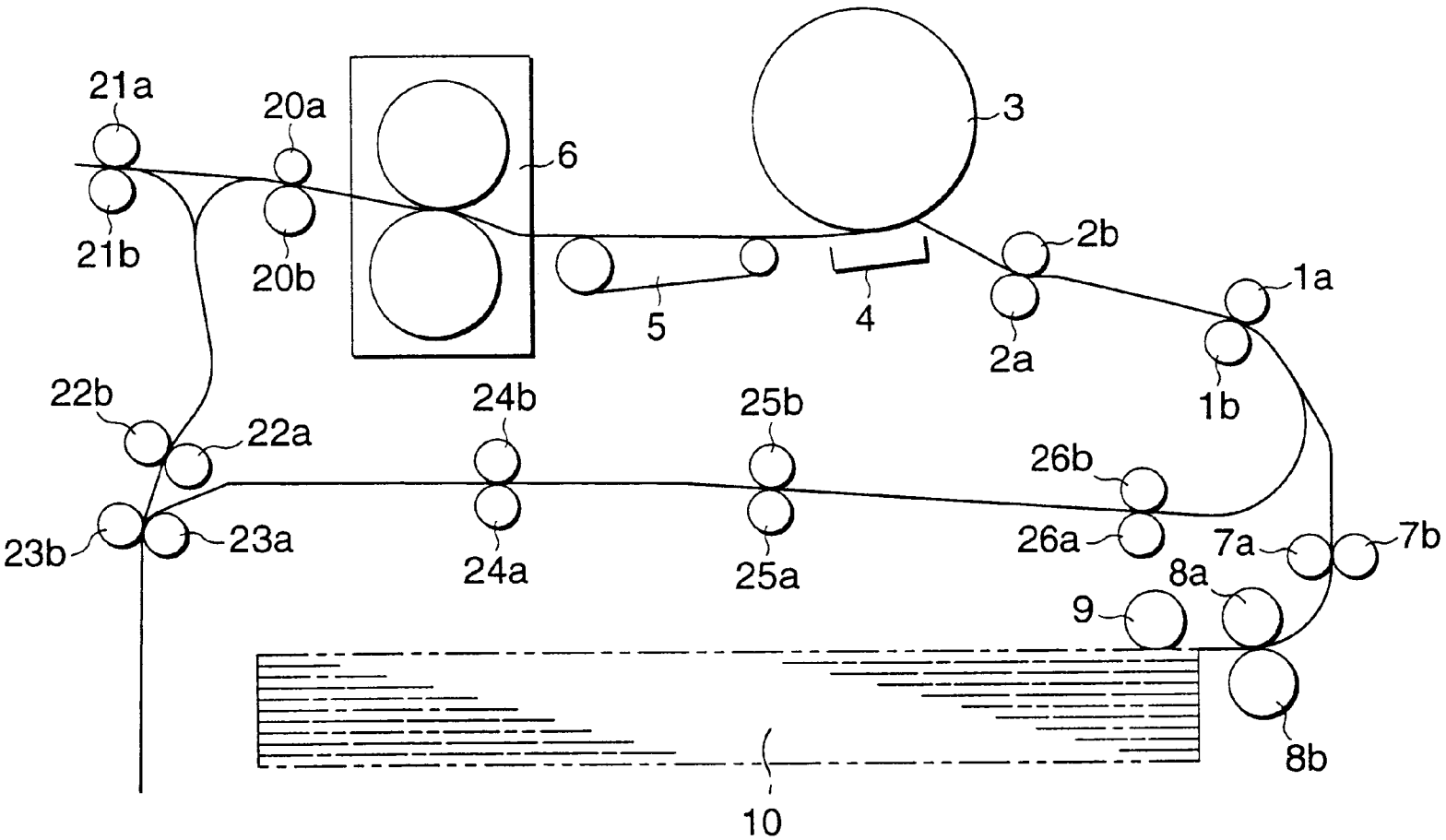
FIG. 1 is a schematic structural view of an electrophotographic printing apparatus.

Now, a description will be given in more detail of a preferred embodiment of the invention with reference to the accompanying drawing.

Referring to FIG. 1, an example of the present invention will be described below. Incidentally, the explanation of components is neglected because it is the same as that of the conventional technology.

In the present invention, when the conveying speed of the timing rollers 1*a* and 1*b* is Vt, the conveying speed of the register rollers 2*a* and 2*b* is Vr, and the peripheral speed of the photoreceptor drum 3 is V0, each speed satisfies the relationship of $V0\geqq Vr>Vt$, and in the case where the sheet deflection amount at the register rollers is $\delta r$, and the sheet length is Lp, when the speed difference having the relationship of $\delta r\geqq Lp\ ((Vr-Vt)/Vt)$ is generated, the sheet deflection amount $\delta r$ is gradually decreased, and thereby the vibration generated when the trailing edge of the sheet is separated from the timing roller 1*a*, can be suppressed.

Specifically, it is set that the speed difference of the conveying speed of the timing rollers 1*a* and 1*b* is −0.5%−−2% to the peripheral speed of the photoreceptor drum 3, the speed difference of the conveying speed of the register rollers 2*a* and 2*b* is +0.5%−+2% at the timing roller ratio, and the conveying speed does not exceed the peripheral speed of the photoreceptor drum 3.

Further, in the case where the peripheral speed of the photoreceptor drum is V0, and the conveying speed of the conveying apparatus 5 is Vf, when the relationship of Vf>V0 is satisfied, and in the case where the sheet deflection amount at the entry portion of the photoreceptor drum 3 is δ0, and the sheet length is Lp, when the speed difference satisfying the relationship of δ0≧Lp ((Vf−V0)/V0) is given, the sheet deflection amount δ0 is gradually decreased, and thereby the vibration generated when the trailing edge of the sheet is separated from the register roller, can be suppressed.

Specifically, the sheet conveying speed of the conveying apparatus 5 is set to be +0.5%–+2% higher than the peripheral speed of the photoreceptor drum 3. According to this, because the vibration generated when the trailing edge of the sheet is separated from the timing roller and register roller is suppressed, the problem of transfer blurring is solved.

Further, because an interval between the timing roller and register roller, and the positional relationship of the register roller and the photoreceptor drum entry are constant, in the case where the length of sheet such as an A4 sheet or a letter sheet is short, and in the case where the length of sheet such as an A3 sheet or a ledger sheet is large, depending on the speed difference, there is no problem in the case where the sheet length is short, but, because there is a case where the deflection is more decreased than the deflection amount when the sheet length is large, by preparing the optimum speed difference corresponding to the sheet length, the more decreasing effect can be obtained. Alternatively, when the sheet deflection amount between the register roller and the timing roller is optimized corresponding to the sheet length, the same effect can be obtained.

According to the present invention, an elecctrophotographic printing apparatus by which the vibration generated when the trailing edge of the sheet is separated from the timing roller ands register roller, is suppressed, and a fine image can be obtained without transfer blurring, can be realized.

What is claimed is:

1. An electrophotographic printing apparatus, comprising:

a timing roller which conveys a sheet sent from a sheet hopper at the predetermined timing;

a register roller to convey the sheet in timed relationship with the timing at which a toner image formed on a photoreceptor drum surface reaches a transfer device; and a conveying apparatus to convey the sheet passed through the transfer device toward a fixing device;

wherein when the conveying speed of the timing roller is Vt, the conveying speed of the register roller is Vr, the peripheral speed of the photoreceptor drum is V0, and the conveying speed of the conveying apparatus is Vf, each speed is set to satisfy the relationship of Vf>V0≧Vr>Vt, and when a sheet deflection amount formed when the sheet comes into contact with the register roller, is δr, the sheet deflection amount at the photoreceptor drum entry section is δ0, and the sheet length is Lp, each value is regulated so that the relationships of δr≧Lp ((Vr−Vt)/Vt) and δ0≧Lp ((Vf−V0)/V0) are satisfied.

2. The electrophotographic printing apparatus according to claim 1, wherein the speed difference of the conveying speed of the timing roller is −0.5%–−2% to the peripheral speed of the photoreceptor drum, the speed difference of the conveying speed of the register roller is +0.5%–+2% at a timing roller ratio, and the conveying speed of the register roller is not larger than the peripheral speed of the photoreceptor drum, and the speed difference of the conveying speed of the conveying apparatus is +0.5%–+2% to the peripheral speed of the photoreceptor drum.

3. The electrophotographic printing apparatus according to claim 1, wherein the speed difference of the conveying speed of the timing roller and register roller can be changed corresponding to the sheet length.

4. The electrophotographic printing apparatus according to claim 1, wherein the deflection amount of the sheet generated at the time of sheet alignment between the register roller and timing roller can be changed corresponding to the sheet length.

* * * * *